United States Patent [19]

Setterberg, Jr.

[11] Patent Number: 4,709,761

[45] Date of Patent: Dec. 1, 1987

[54] WELL CONDUIT JOINT SEALING SYSTEM

[75] Inventor: John R. Setterberg, Jr., Victoria, Tex.

[73] Assignee: Otis Engineering Corporation, Dallas, Tex.

[21] Appl. No.: 867,015

[22] Filed: May 27, 1986

Related U.S. Application Data

[62] Division of Ser. No. 626,442, Jun. 29, 1984, Pat. No. 4,602,796.

[51] Int. Cl.[4] ..... E21B 29/00; B23B 41/12

[52] U.S. Cl. ..... 166/387; 166/376; 175/288; 277/171; 408/82; 409/143

[58] Field of Search ..... 166/55.1, 55.7, 377, 166/380, 387, 376; 175/272, 288; 409/143; 408/80, 82, 83.5; 277/30, 125, 171, 236

[56] References Cited

U.S. PATENT DOCUMENTS

| | | | |
|---|---|---|---|
| Re. 25,860 | 9/1965 | Elias | 408/82 |
| 1,038,914 | 9/1912 | Long | 408/82 |
| 2,295,856 | 9/1942 | Mallory | 408/82 |
| 2,709,490 | 5/1955 | Trimble et al. | 409/143 |
| 3,164,039 | 1/1965 | Woods | 408/82 |
| 3,871,456 | 3/1975 | Sizer et al. | 166/72 |
| 4,147,462 | 4/1979 | Appleby et al. | 408/80 |
| 4,288,082 | 9/1981 | Setterberg, Jr. | 166/118 |
| 4,496,162 | 1/1985 | McEver et al. | 277/30 |

*Primary Examiner*—Stephen J. Novosad
*Assistant Examiner*—Terry Lee Melius
*Attorney, Agent, or Firm*—Roland O. Cox

[57] ABSTRACT

Disclosed is apparatus and method for a system useful in establishing a metal to metal seal between conduit joints in wells. A milling tool having means controlling down force on and positioning the cutter is used to cut and/or finish a seat on a shoulder in a well conduit, which will mate and seal with metal seal surfaces on seal units lowered on conduits into the well. One seal unit has elastomeric seals in addition to the metal seals.

16 Claims, 14 Drawing Figures

WELL CONDUIT JOINT SEALING SYSTEM

This application is a division of my copending application for patent, Ser. No. 626,442, filed June 29, 1984, now U.S. Pat. No. 4,602,796.

BACKGROUND

This invention relates to apparatus for repairing or cutting a seat for a metal seal in a conduit or tool member in an earth well and metal seal apparatus for installation in the well to seal on the seat.

There have been a number of failures of conventional seal rings made of elastomeric materials, which were used to seal in bores in downhole well tools, anchored in well casing. These seal rings are usually mounted on a seal unit connected to the lower end of a flow conduit lowered into the well and into a tubular seal receptacle on top of downhole well tools, such as liner hangers or production packers, which has been smooth bored inside for sealing. Examples of such use of elastomeric seals is shown on page 1456 of the 1982–83 "Composite Catalog of Oilfield Equipment and Services", in the form of o-ring and compression seals on "tie-back" stems and packers.

A sealing system utilizing elastomeric and metal seal rings is disclosed in U.S. Pat. No. 4,288,082, of which I am the inventor. Another example of a sealing system utilizing metal, elastomeric and thermoplastic materials, is disclosed in U.S. Pat. No. 4,433,847 to Weinberg.

The apparatus and method of this invention provide a unique milling tool for cutting and/or finishing a seat on a shoulder in a well conduit or tool anchored in the well casing. A seal unit, having a deformable metal seal ring slidably mounted near an outside seal surface on its lower end, is then lowered on pipe into the well until an outside seal surface on the ring engages the seat. Weight of the pipe lowering string is then applied to the seal unit, which compresses the metal ring between the seat and seal unit and deforms the metal seal ring sufficiently to seal on the seat and seal unit and establish the seal between the seal unit and well tool. The metal seal of this invention will better resist high deep well temperatures and chemical deterioration of elastomeric materials caused by hydrocarbons in earth wells and provides a much longer lasting and more reliable seal than elastomeric material seals previously used. Higher pressures can be sealed because much greater compressive loads can be placed on the metal seals than on elastomeric materials.

The milling tool of this invention provides for formation of a seat on a shoulder in a well conduit while in the well. This milling tool will cut and smooth finish the whole seat or "redress" or smooth finish for sealing a seat previously cut. The downward force of the milling tool cutter on the seat may be controlled. The profile formed by the milling tool mates with the outside seal surface on the metal ring and the outside seal surface on the lower end of the seal unit. The seal unit metal ring is thicker, in the section compressed between the seat and the seal unit, and prevents the outside seal surface on the lower end of the seal unit from initially engaging the seat. When sufficient load is placed on the seal unit to compress the metal ring between the seal unit and seat and reduce the thickness of the metal ring, the outer seal surface on the lower end of the seal unit also engages the seat and forms an additional metal to metal seal with the seat prepared by the milling tool. The additional seals' diameter of seal is smaller than the seal rings' diameter of seal and the additional seal exposes a smaller sealed area reducing the "piston" force trying to move seal unit up. Additionally, the smaller sealed area on the additional seal provides for the sealing greater pressures with the same load down on the seal unit. Further, the additional area engaged in compression provides for the support of greater pipe loads on the seal unit and prevents the slidable metal ring from being crushed so it will no longer seal.

Downwardly and inwardly tapering angles of 5° to 45° with the longitudinal axis of the tools were found useful for all metal seal surfaces. Angles of 12°–15° were found preferable for metal seal surfaces and cutting on seats with the milling tool.

The system of this invention is particularly useful to replace failed elastomeric downhole well seals with longer lasting metal seals and reseal between well tool members allowing the well to continue production.

An object of this invention is to provide apparatus and a method for establishing an improved seal between conduit joints in a well.

An object of this invention is to provide apparatus for cutting and/or finishing a seat having a particular profile on a shoulder in a well conduit.

Another object of this invention is to establish an improved seal between conduit joints by retrieving only a portion of the conduit string from the well.

BRIEF DRAWING DESCRIPTION

DESCRIPTION OF THE PREFERRED EMBODIMENT

Figure 1:
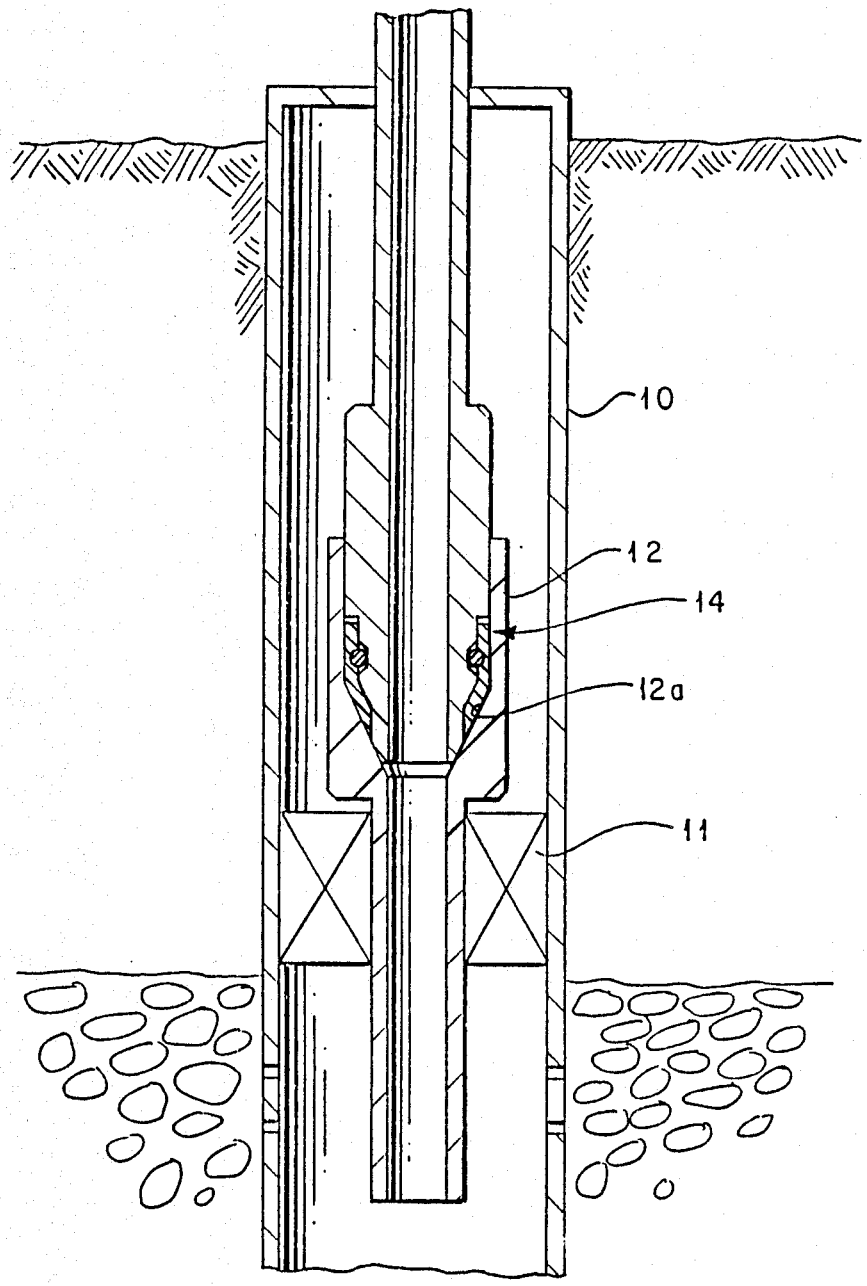
FIG. 1 is schematic drawing of a well wherein downhole tools have been sealed using the improved seal unit and apparatus of this invention.
Figures 2A, 2B:
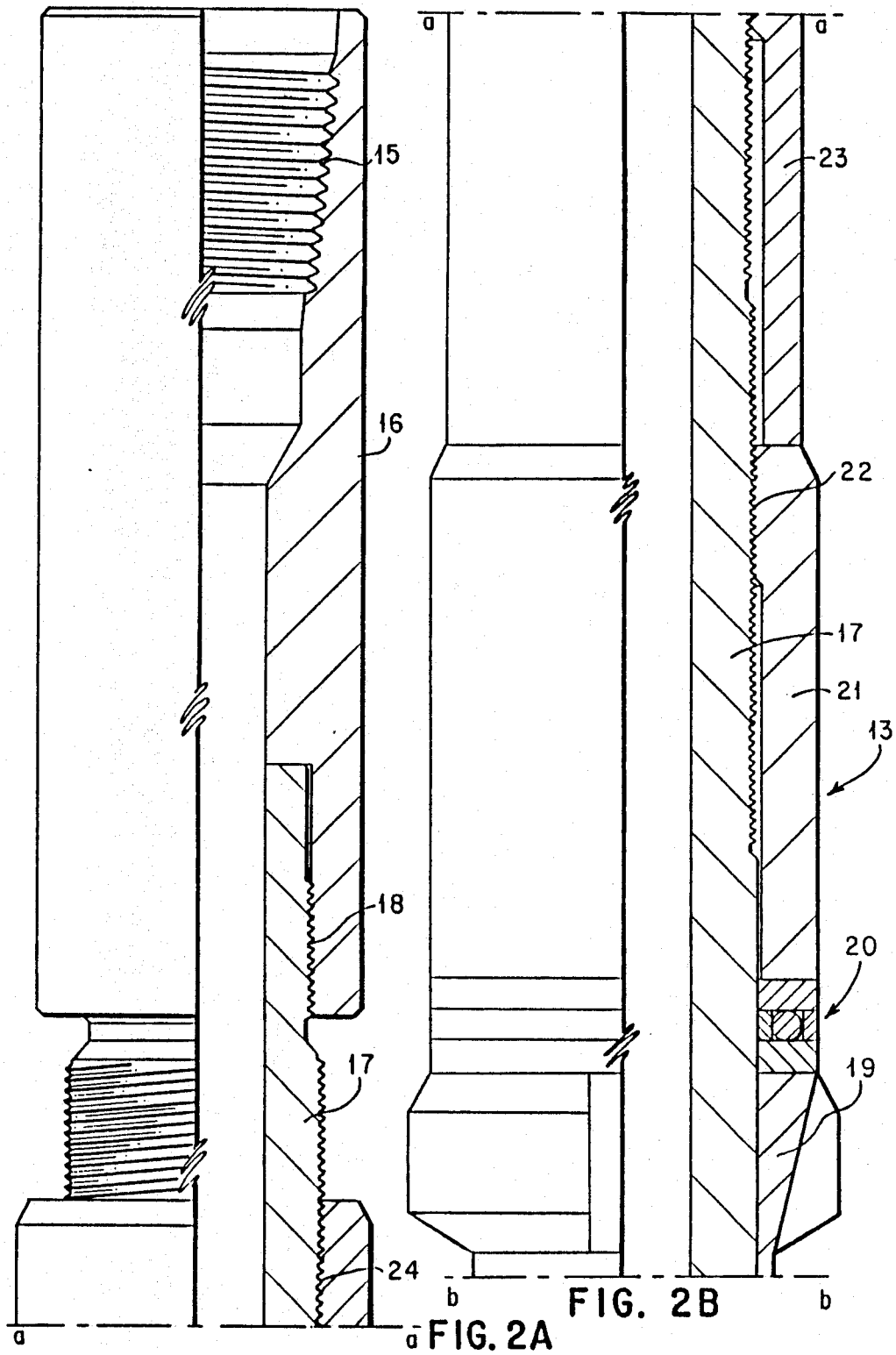
FIG. 2 (A–F) is a half sectioned drawing in elevation, of the unique milling tool of this invention.
Figure 2C:
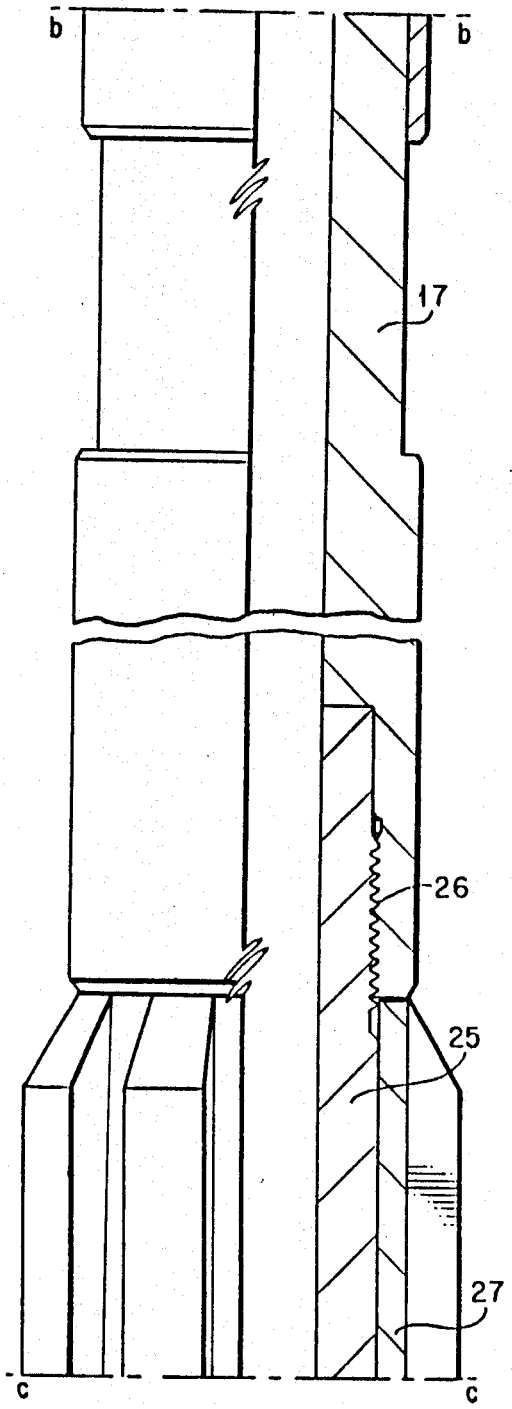
Figure 2D:
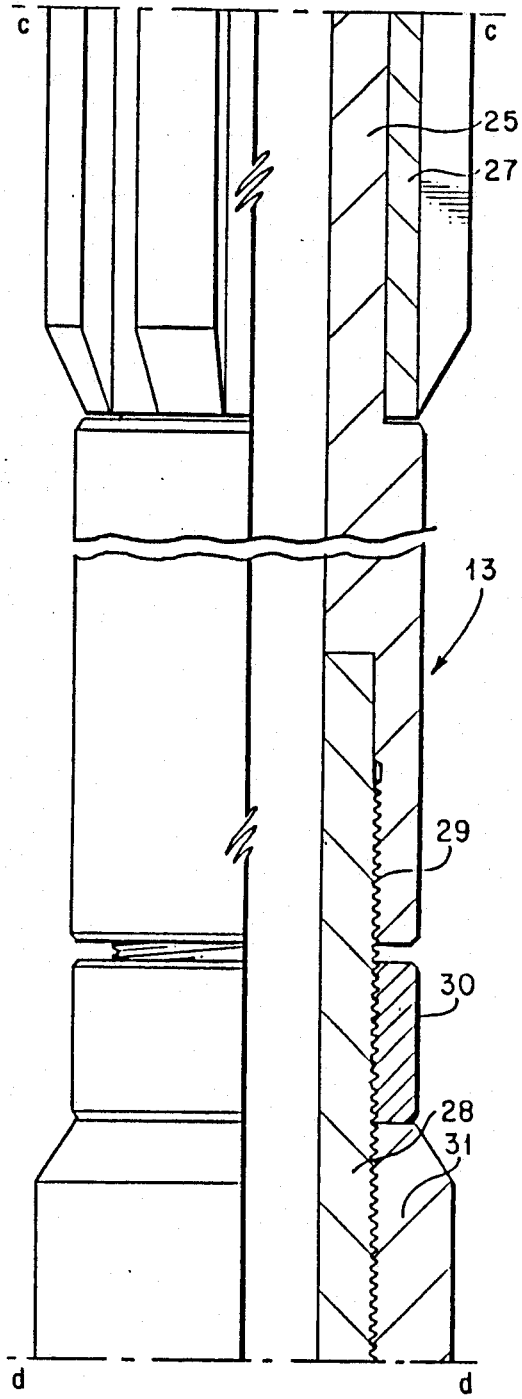
Figure 2E:
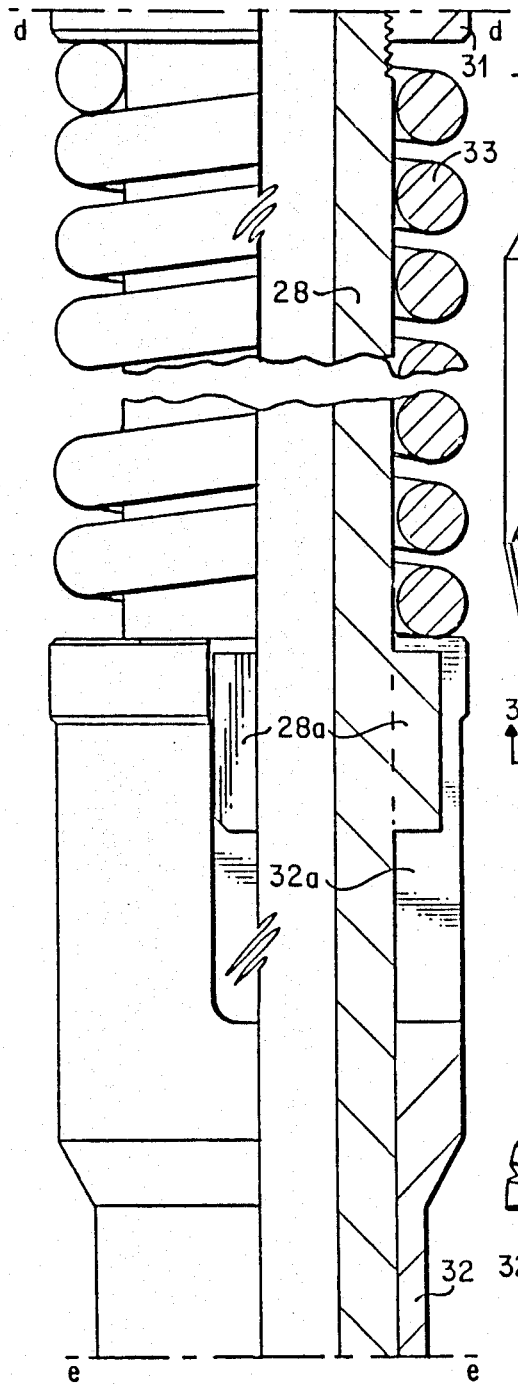
Figure 2F:
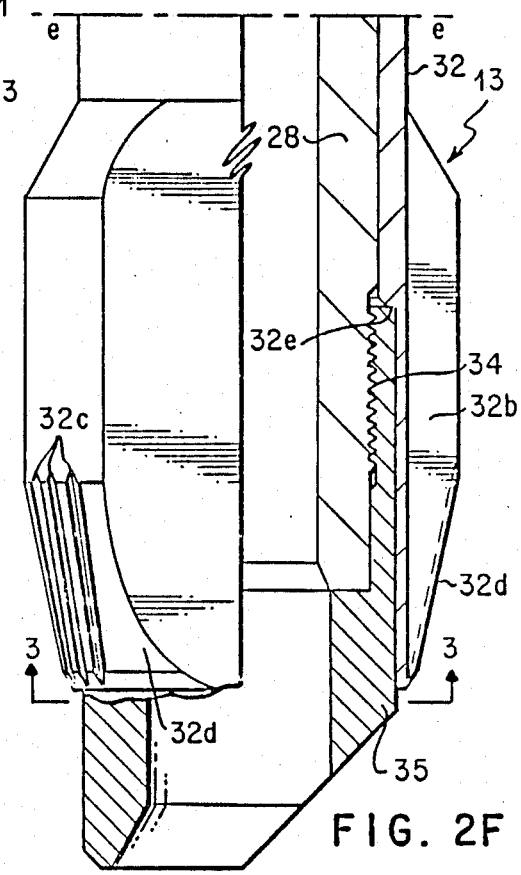
Figure 3:
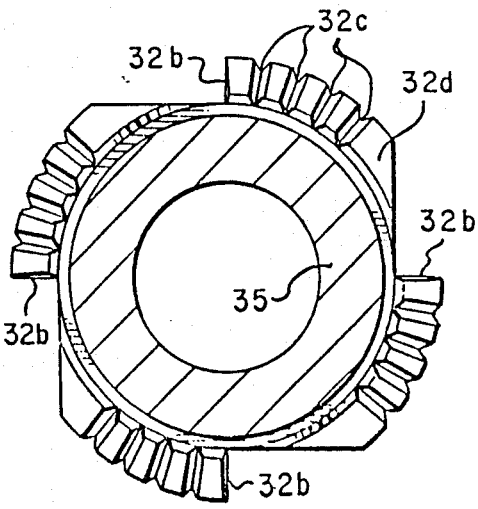
FIG. 3 is a section along line 3—3 of FIG. 2.

FIG. 1 shows an earth well utilizing the system of this invention. A casing 10 has been installed in the earth bore hole. A packer 11, set in the casing, positions therein a well tool or conduit 12 having an internal shoulder. A seating surface 12a has been formed for sealing on the shoulder, using milling tool 13 of this invention shown in FIG. 2. A seal unit 14 (FIG. 5) having a lower metal seal ring **14*a* has been attached to a well pipe and lowered into the well until the seal ring is resting on prepared sealing surface 12*a*. The millng tool has cut a profile on the shoulder which mates with the contacting profile on the seal unit seal ring. Well pipe weight has been applied to the seal unit, compressing and deforming the metal seal ring into complete sealing engagement with the shoulder seal surface. Sufficient pipe weight has been added to compress the metal seal ring between angled seal surfaces on the seal mandrel and seal surface 12***a* and to sealingly engage the mandrel lower end outside seal surface with sealing surface 12*a*.

The milling tool 13 of FIG. 2 has an appropriate thread connection 15 in top sub 16 for connection to a rotatable well pipe. The top sub is connected to upper mandrel 17 with thread 18. Slidably mounted on this mandrel is a shoulder ring 19 and a bearing 20. An adjusting ring 21 is movable by screwing up or down thread 22 on the mandrel. A lock ring 23 may be tightened against the adjusting ring on mandrel thread 24. An intermediate mandrel 25 is connected to the lower end of the upper mandrel with thread 26. A slotted guide sleeve 27 is rotatably positioned on the intermediate mandrel between the lower end of the upper mandrel and a shoulder on the intermediate mandrel. Lower mandrel 28 is provided with drive lugs 28*a* and is connected to the intermediate mandrel with threads 29. Mounted on threads 29 is lock ring 30 and an adjusting ring 31. Also mounted around the lower mandrel, between the adjusting ring and a cutter 32, is a spring 33. The cutter is provided with slots 32*a*, in which drive lugs 28*a* are slidably positioned and cutting or milling surfaces 32*b* and grooves 32*c* are formed on the surfaces 32*d* of the cutter for cutting a particular seat profile on an internal shoulder in a receptacle. Surfaces 32*d* form an angle of preferably 12° to 15° with the longitudinal axis of the cutter. Connected to the lower end of lower mandrel 28 by thread 34 is a guide 35. Adjusting ring 31 may be screwed down compressing spring 33 causing internal cutter shoulder 32*e* to bear down with greater force on the upper end of the guide.

Figure 5A:
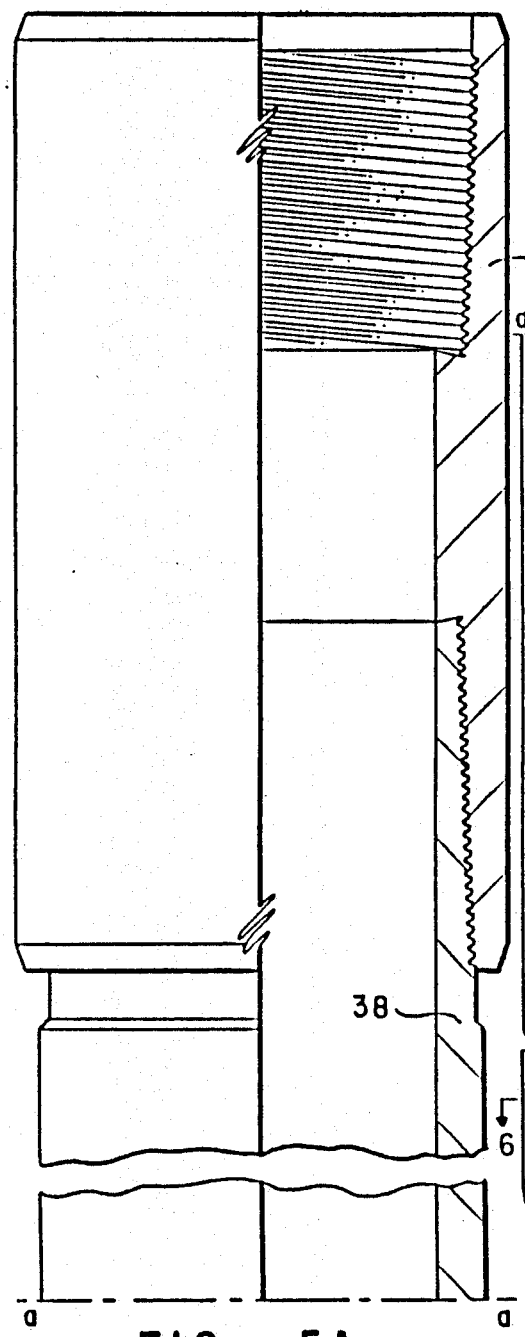
FIG. 5 (A and B) is a half sectioned drawing in elevation of a seal unit having a metal seal ring on the lower end.
Figure 5B:
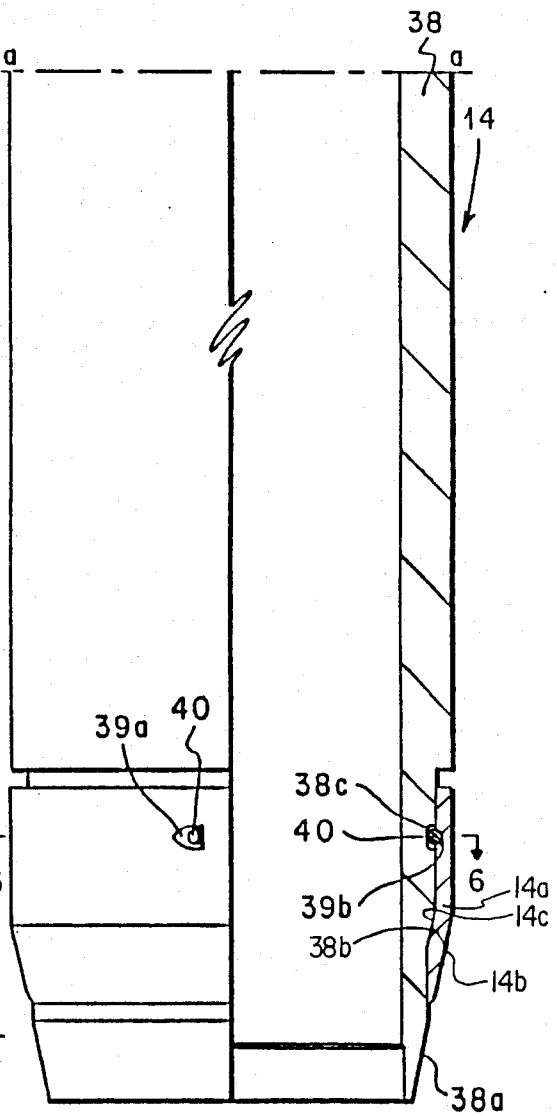
Figure 6:
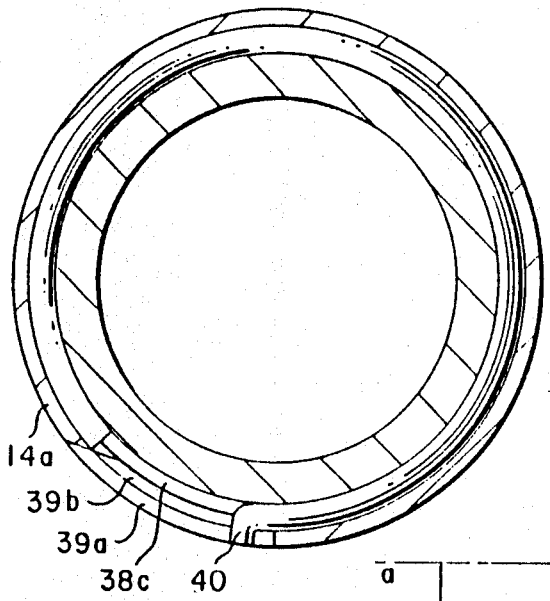
FIG. 6 is a section along lines 6—6 of FIG. 5, showing detail of the metal seal ring-seal mandrel connection.

The seal unit 14 shown in FIG. 5, has a threaded connector 37 on its upper end for connecting seal mandrel 38 to the lower end of conduits lowered into wells. Seal surfaces 38*a* and 38*b* on the lower end of the seal mandrel are formed at preferred angles of 12° to 15° with the longitudinal axis of the mandrel. Slidably mounted on the lower end of the mandrel is a metal seal ring 14*a*. The ring is retained in a groove 38*c*, around the mandrel, by a wire 40 driven thru a slot 39*a* in the metal ring and into groove 38*c* and groove 39*b* in the metal ring, as shown by FIGS. 5 and 6.

The slidably connected metal ring fits loosely around the seal mandrel and may be moved slightly radially on the mandrel, allowing the metal ring to misalign slightly with the seal mandrel and still sealingly engage a slightly misaligned seat. Seal 14*a*, FIG. 5B, has an angled outside seal surface 14*b* which is sealingly engageable with seat 12*a* and an angled inside seal surface 14*c* which is sealingly engageable with angled outside seal surface 38*b* on mandrel 38.

Figure 7A:
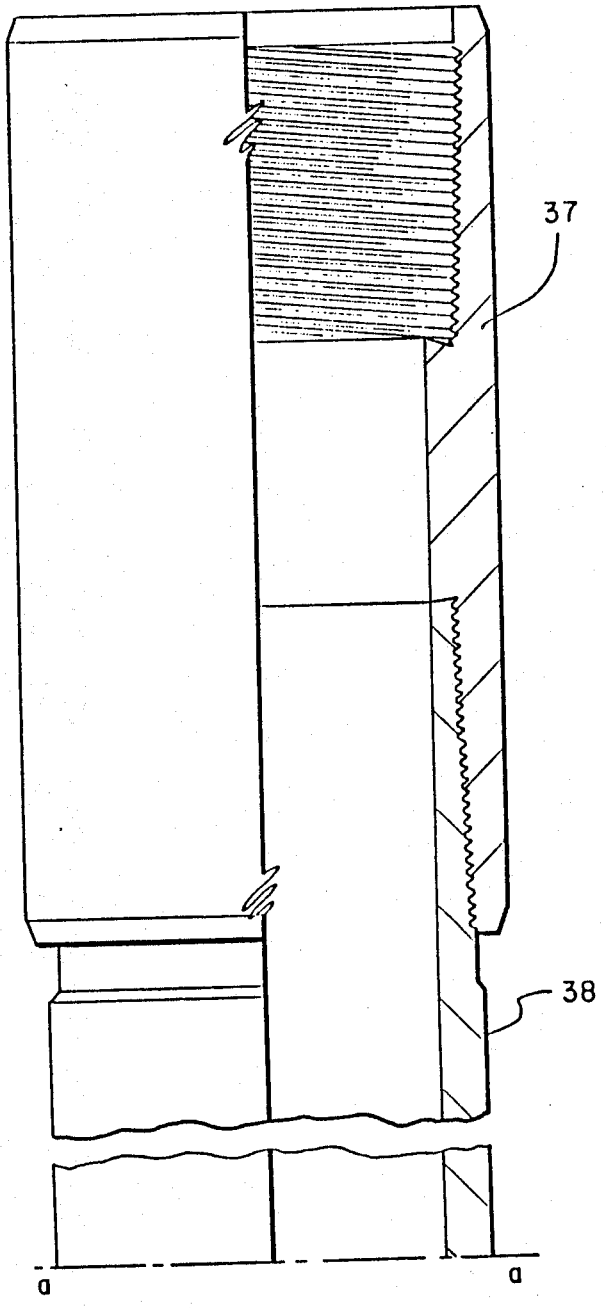
FIG. 7 (A and B) is a half sectioned drawing of the seal unit of FIG. 5 with an elastomeric seal section above the metal seals.
Figure 7B:
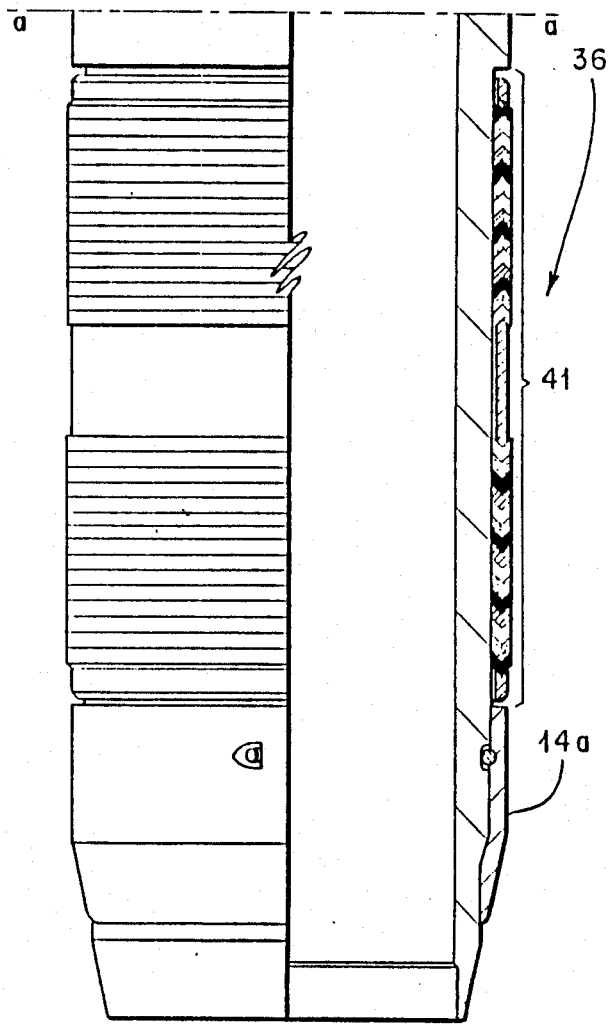

Seal unit 36 shown in detail in FIG. 7, has an additional elastomeric seal section 41 on the seal mandrel above the metal seal ring. In some wells, it is very desirable to have one or more elastomeric seal sections in addition to the metal seal on seal units for complete and longer lasting sealing, especially if there is a seal receptacle above the metal seal shoulder in the tool or conduit anchored in the well.

To utilize this invention and establish an improved metal to metal seal between pipes or tools in a well, the leaking seal unit is removed from the tool anchored in the well casing and retrieved from the well. A milling tool, as shown in FIG. 2, which may be adjusted to control downward force compressed spring 33 exerts on top of cutter 32 to engage shoulder 32*e* with the top of guide 35, by turning adjusting ring 31 and securing the ring's position with ring 30. This adjustment may be used to control cutter force down on the shoulder in the well while forming the seal surface. The milling tool is next attached to rotatable pipe and lowered into the well, until surface 32*d* on cutter 32 contacts the internal shoulder in the well conduit or tool, on which is to be formed a seal surface to sealingly engage the metal seal surfaces on seal units 36 or 14. Pipe weight is then applied on the milling tool, moving the milling tool mandrels downwardly, compressing spring 33 and forcing the cutter down on the shoulder, while moving the upper end of guide 35 out of contact with cutter shoulder 32*e*. The milling tool is then rotated by turning pipe at the surface until the shoulder is properly formed and smoothed into a seal surface and cutter shoulder 32*e* is again bearing on the upper end of guide 35. The pipe and milling tool are retrieved from the well and seal unit 14 is made up on pipe to be lowered into the well to engage and seal on the prepared seal surface.

Figure 4:
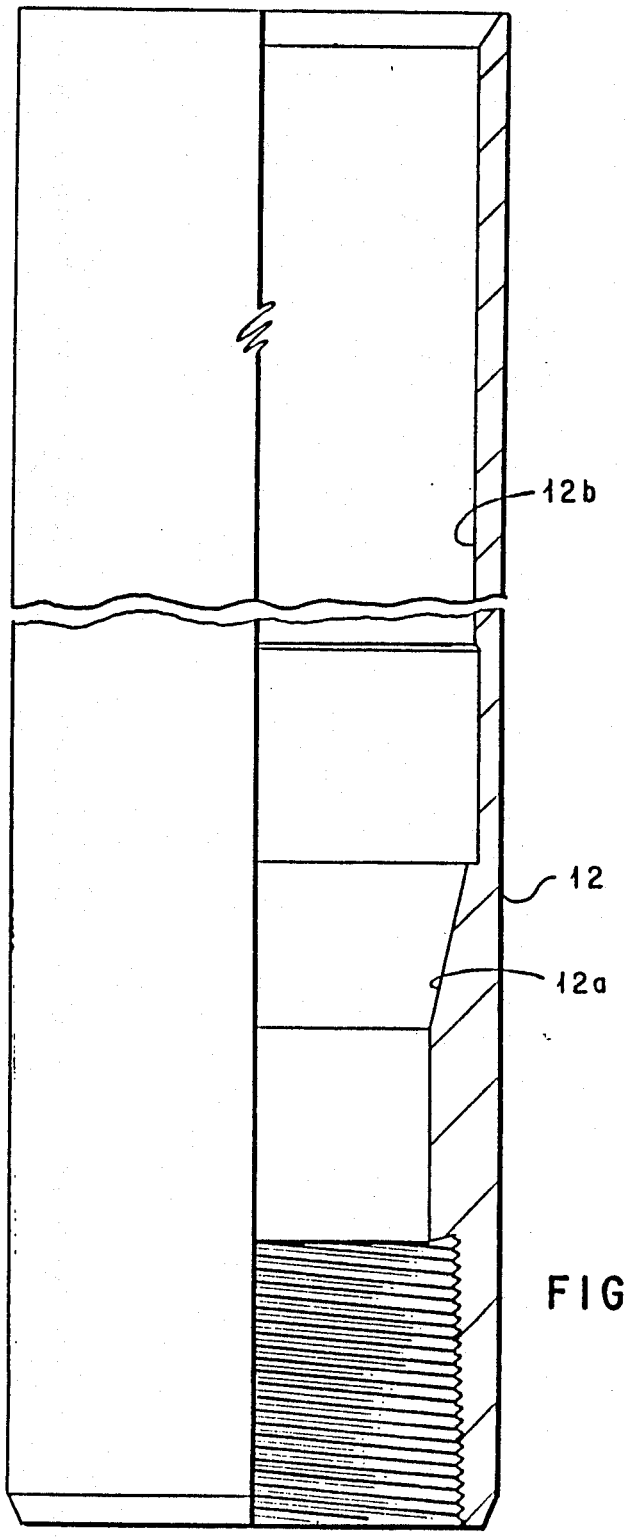
FIG. 4 is a drawing in elevation of a typical seal receptacle in which the milling tool of FIG. 2 has formed a seat.

If the tool anchored in the well has a seal receptacle such as 12, FIG. 4, with a bore 12*b* for seals, the distance from the top of the receptacle to the shoulder on which the seat 12*a* is to be formed is usually known. Before the milling tool is lowered to form the seal surface, to limit downward cutting travel of the cutter, shoulder ring 19 and bearing 20 may be positioned a predetermined distance from cutter surfaces 32*d* by rotating adjusting ring 21 and locking it in place with ring 23. The cutter force down may be adjusted as previously described. The milling tool is then lowered into the well receptacle until cutter surfaces 32*d* contact the shoulder to be formed. Pipe weight on the milling tool will move the milling tool mandrels downwardly compressing spring 33 which pushes cutter 32 downwardly on the shoulder, until shoulder ring 19 contacts the receptacle top and positions milling tool guide 35 to stop downward movement of the cutter. Rotation of the pipe will turn the milling tool mandrels on bearing 20 while compressed spring 33 moves the cutter shoulder 32*e* toward the top of guide 35 as the seal surface is being formed on the shoulder in the receptacle.

After the seal surface 12*a* is completely formed on the receptacle shoulder, the milling tool is retrieved from the well and a seal unit 36, FIG. 7, with elastomeric seals 41 in addition to the metal lower end and ring seal 14*a*, should be installed in the receptacle to sealingly engage seal surfaces 12*a* and 12*b*.

I define my invention by the following claims and claim:

1. A milling tool for forming an upwardly facing sealing surface on a shoulder in a conduit comprising:

(a) an upper mandrel having a top connector, releasably positioned shoulder means on said upper mandrel including a lock ring threaded on said upper mandrel an adjusting ring threaded on said mandrel below said lock ring, a shoulder ring rotatably mounted on said mandrel below said adjusting ring, and a thrust bearing mounted around said upper mandrel between said adjusting and shoulder rings;

(b) an intermediate mandrel connected to said upper mandrel, said mandrel having a guide sleeve rotably mounted thereon;

(c) a lower mandrel connected to said intermediate mandrel, said lower mandrel having a cutter slidably mounted thereon, said cutter having an internal shoulder and a downwardly facing frusto-conical cutting surface forming an angle of 12°–15° with the longitudinal axis of the cutter, adjustable biasing means mounted on said lower mandrel including an adjusting ring threaded on said lower mandrel, a spring around said lower mandrel between said ring and said cutter, and a lock ring threaded on said lower mandrel above said adjusting ring, said lower mandrel having a shoulder engageable by said internal cutter shoulder; and (d) means for keying said lower mandrel to said cutter including slots in the upper end of the cutter and lugs protruding from the lower mandrel, one said lug engaged in each of said cutter slots.

2. A milling tool for forming an upwardly facing sealing surface on a shoulder in a conduit comprising:

(a) an upper mandrel having a top connector;

(b) an intermediate mandrel connected to said upper mandrel;

(c) a lower mandrel connected to said intermediate mandrel having a cutter slidably mounted thereon, adjustable biasing means for controlling downward force on said cutter including an adjusting ring threaded on said lower mandrel and a spring around said lower mandrel between said ring and said cutter, and a shoulder limiting downward travel of said cutter; and (d) means for keying said lower mandrel to said cutter.

3. The milling tool of claim 2 wherein the keying means comprise:

(a) slots in the upper end of the cutter; and (b) lugs protruding from the lower mandrel, one said lug slidably engaged in each of said cutter slots.

4. The milling tool of claim 2 wherein the cutter has a downwardly facing frusto-conical cutting surface, said surface forming an angle of from 5° to 45° with the longitudinal axis of the cutter.

5. The milling tool of claim 4 wherein the cutting surface forms an angle of 12°–15° with the cutter axis.

6. The milling tool of claim 2 wherein the cutter is provided with an internal shoulder engageable with the lower mandrel shoulder.

7. The milling tool of claim 2 wherein the adjustable biasing means further include a lock ring threaded on the lower mandrel above the biasing means adjusting ring.

8. The milling tool of claim 2 further including a guide sleeve rotatably mounted on the intermediate mandrel.

9. The milling tool of claim 2 further including releasably positioned shoulder means on the upper mandrel for positioning said shoulder means a predetermined distance from the lower mandrel shoulder.

10. The milling tool of claim 9 wherein the shoulder means comprise:

(a) a lock ring threaded on the upper mandrel;

(b) an adjusting ring threaded on the upper mandrel below said lock ring; and (c) a shoulder ring rotatably mounted on said mandrel below said adjusting ring.

11. The milling tool of claim 10 wherein the shoulder means further include a thrust bearing mounted around the upper mandrel between the adjusting ring and the shoulder ring.

12. The milling tool of claim 9 further including a guide sleeve rotatably mounted on the intermediate mandrel.

13. A method of sealing conduit joints in a well comprising the steps of:

(a) lowering a milling tool having a cutter and means for controlling downward force on said cutter, on pipe into the well to engage said cutter on a shoulder in a conduit in the well;

(b) forming an upwardly facing sealing surface on said shoulder by applying pipe weight to said milling tool and cutter and rotating said cutter on said shoulder;

(c) replacing the milling tool with a seal unit on pipe having a metal lower end and a slidably connected metal seal ring thereon, said lower end and said metal ring each having surfaces sealingly engageable with said sealing surface; and (d) applying sufficient pipe weight to said seal unit to compress and deform the seal unit seal ring and lower end surfaces into sealing engagement with said sealing surface.

14. The method of claim 13 wherein prior to lowering the milling tool into the well conduit, the means controlling downward force is adjusted for the desired downward force on the cutter.

15. A method of sealing conduit joints in a well comprising the steps of:

(a) lowering a milling tool having a cutter, means for controlling downward force on said cutter and releasably positioned shoulder means, on pipe into the well to engage said cutter on a shoulder in a well conduit having a seal bore, said releasably positioned shoulder means landing on said conduit;

(b) forming an upwardly facing sealing surface on said shoulder by applying pipe weight to said milling tool and cutter and rotating said cutter on said shoulder;

(c) replacing the milling tool with a seal unit on pipe having a metal lower end, a slidably connected metal seal ring thereon and one or more elastomeric seal sections thereon above said metal ring, said lower end and said metal ring each having surfaces sealingly engageable with said sealing surface and said elastomeric sections sealingly engageable in said receptacle seal bore;

(d) positioning said seal unit lower end surface on said formed sealing surface and said elastomeric section in sealing engagement in said seal bore; and (e) applying sufficient pipe weight to said seal unit to compress and deform the seal unit seal ring and lower end surface into sealing engagement with said sealing surface.

16. The method of claim 15 wherein prior to lowering the milling tool into the well conduit, the milling tool shoulder means is positioned the desired distance from the cutter and the means controlling downward force on the cutter is adjusted for the desired downward force on said cutter.

* * * * *